US009361843B2

(12) United States Patent
Ko et al.

(10) Patent No.: US 9,361,843 B2
(45) Date of Patent: Jun. 7, 2016

(54) INPUT BUFFER CIRCUIT AND GATE DRIVER IC INCLUDING THE SAME

(71) Applicant: SILICON WORKS CO., LTD., Daejeon-si (KR)

(72) Inventors: Young Keun Ko, Cheongju-si (KR); An Young Kim, Daejeon-si (KR)

(73) Assignee: SILICON WORKS CO., LTD., Daejeon-Si (KR)

( * ) Notice: Subject to any disclaimer, the term of this patent is extended or adjusted under 35 U.S.C. 154(b) by 158 days.

(21) Appl. No.: 14/039,979

(22) Filed: Sep. 27, 2013

(65) Prior Publication Data

US 2014/0091998 A1 Apr. 3, 2014

(30) Foreign Application Priority Data

Sep. 28, 2012 (KR) ..... 10-2012-0108575

(51) Int. Cl.
*G09G 3/36* (2006.01)

(52) U.S. Cl.
CPC ..... *G09G 3/3674* (2013.01); *G09G 2310/0291* (2013.01)

(58) Field of Classification Search
CPC ..... G09G 3/3674; G09G 2310/0291
See application file for complete search history.

(56) References Cited

U.S. PATENT DOCUMENTS 7,449,913 B1 * 11/2008 Hung ..... H03K 17/163 326/26

FOREIGN PATENT DOCUMENTS

JP 2011-135523 7/2011
KR 10-2008-0000746 1/2008

* cited by examiner

*Primary Examiner* — Sahlu Okebato
(74) *Attorney, Agent, or Firm* — Kile Park Reed & Houtteman PLLC

(57) ABSTRACT

The present invention discloses an input buffer circuit capable of recognizing and driving a low-voltage signal, output from a low-voltage environment, in a high-voltage environment and a gate driver IC including the input buffer circuit. The input buffer circuit is configured to include two or more multi-stage inverters and to recognize and output a gate signal having a different voltage domain from an operating voltage. Accordingly, a signal interface environment between chips operating in different voltage domains can be provided.

6 Claims, 9 Drawing Sheets

INPUT BUFFER CIRCUIT AND GATE DRIVER IC INCLUDING THE SAME

BACKGROUND OF THE INVENTION

1. Field of the Invention

The present invention relates to an input buffer circuit, and more particularly, to an input buffer circuit which provides a signal interface environment between chips having different voltage domains and a gate driver Integrated Circuit (IC) including the input buffer circuit.

2. Description of the Related Art

A flat panel display device displays an image using a flat display panel like an LCD, an LED, and an OLED.

For example, an LCD requires a gate driving signal and a source driving signal in order to display an image. An LCD includes an LCD panel for displaying an image, a gate driver IC for providing a gate driving signal to the LCD panel, a source driver IC for providing a source driving signal to the LCD panel, and a timing controller for providing a gate signal and a control signal to the gate driver IC and a source signal and a control signal to the source driver IC.

Most semiconductor parts mounted on a flat panel display device adopt various aspects of techniques for reducing consumption power. For example, an LCD can be driven according to a low-voltage driving method in order to reduce consumption power.

In order for an LCD to be driven according to the low-voltage driving method, the timing controller or the source driver IC fabricated by a low-voltage process is mounted on the LCD. The low-voltage process means a manufacture process of forming elements designed to operate in response to an operating voltage of a low-voltage domain.

In contrast, the gate driver IC is fabricated by a high-voltage process due to an operating characteristic in which the LCD panel is driven by high voltage. The high-voltage process means a manufacture process of forming elements designed to operate in response to an operating voltage of a high-voltage domain that is higher than a low-voltage domain.

For example, the timing controller or the source driver IC can be designed and fabricated to operate in a low-voltage domain having an operating voltage of 1.8 V to 2.0 V, and the gate driver IC can be designed and fabricated to operate in a high-voltage domain having an operating voltage of 3.3 V to 6 V.

If signals need to be transmitted and received between chips having different voltage domains used in driving, in general, a signal is converted into a voltage level suitable for a voltage domain of a chip that receives a signal to be transmitted by a chip that will send the signal.

In the case of the timing controller and the gate driver IC, the timing controller driven in a low-voltage domain is configured to convert the gate signal suitably for a high-voltage domain and to output the converted signal so that the converted signal can be recognized by the gate driver IC that is driven in a high-voltage domain. That is, the timing controller requires an additional circuit for converting the gate signal, internally generated in a low-voltage domain, suitably for a high-voltage domain and outputting the converted signal. Accordingly, there is a problem in that the chip size is increased by the size of the additional circuit configured in the timing controller.

As described above, the size of a chip that sends a signal is increased by the size of an additional circuit configured to solve a signal interface.

SUMMARY OF THE INVENTION

Accordingly, the present invention has been made in an effort to solve the problems occurring in the related art, and an object of the present invention is to provide an input buffer circuit capable of improving the size of a transmission-side chip in such a manner that a reception-side chip, from among chips operating in different voltage domains, receives a signal having a different voltage domain from a signal of the reception-side chip and processes the received signal and a gate driver IC including the input buffer circuit.

Another object of the present invention is to provide an input buffer circuit capable of providing an interface environment in which a reception chip can select and process two or more signals of different voltage domains by improving the signal interface environment of the reception chip and a gate driver IC including the input buffer circuit.

In order to achieve the above objects, according to one aspect of the present invention, there is provided an input buffer circuit including a first input buffer configured to include two or more inverters coupled in multiple stages, a second input buffer configured to include the two or more inverters, a transfer circuit configured to transfer an input signal to any one of the first input buffer and the second input buffer in response to an external selection signal, and an output circuit configured to select the first input buffer or the second input buffer to which the input signal has been transferred in response to the selection signal and output a signal received from the first input buffer or the second input buffer, wherein center values of input voltages to the first inverters of the first input buffer and the second input buffer are differently set in order to recognize the input signals of different voltage domains.

According to another aspect of the present invention, there is provided an input buffer circuit, including a first inverter configured to receive an input signal of a first voltage domain and one or more second inverters coupled in series with the first inverter, wherein the first inverter and the one or more second inverters are driven by an operating voltage of a second voltage domain, and a center value of an input voltage to the first inverter is set to be lower than a center value of an input voltage to each of the second inverters.

According to yet another aspect of the present invention, there is provided a gate driver IC, including an input buffer circuit configured to include a first input buffer for receiving a gate signal of a first voltage domain, convert the gate signal of the first voltage domain into a gate signal of a second voltage domain, and output the gate signal of the second voltage domain, a shift register configured to sequentially output scan pulses in response to the gate signal of the second voltage domain, a level shifter configured to convert a level of the scan pulse, and an output driver configured to output a gate driving signal in response to the output of the level shifter.

BRIEF DESCRIPTION OF THE DRAWINGS

The above objects, and other features and advantages of the present invention will become more apparent after a reading of the following detailed description taken in conjunction with the drawings, in which.

DETAILED DESCRIPTION OF PREFERRED EMBODIMENTS

Figure 1:
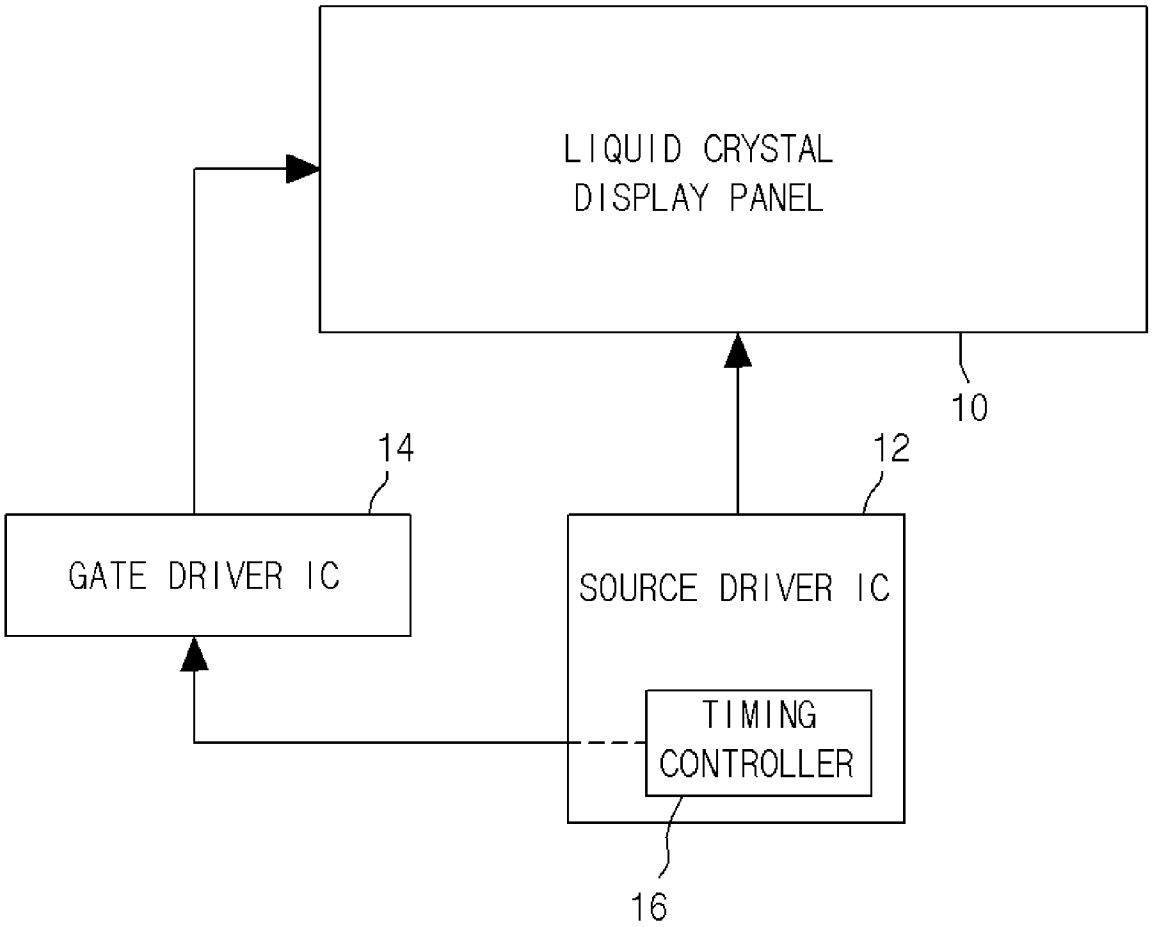
FIG. 1 is a block diagram showing an exemplary embodiment of a flat panel display device in accordance with the present invention.

Reference will now be made in greater detail to a preferred embodiment of the invention, an example of which is illustrated in the accompanying drawings. Wherever possible, the same reference numerals will be used throughout the drawings and the description to refer to the same or like parts.

The present invention discloses a technique in which a reception chip that receives a signal can receive and process a signal having a different voltage domain. In particular, the present invention discloses a technique in which in a flat panel display device, a gate driver IC driven by an operating voltage of a high-voltage domain receives, converts, and processes a gate signal of a low-voltage domain. That is, an embodiment of the present invention is configured in such a manner that a gate signal of a low-voltage domain provided by a timing controller is transmitted to the gate driver IC driven by an operating voltage of a high-voltage domain and the gate driver IC receives the gate signal of a low-voltage domain, converts the gate signal of a low-voltage domain into a gate driving signal of a high-voltage domain according to an internal process, and outputs the converted gate driving signal.

Embodiments of the present invention are described with reference to FIGS. 1 to 5.

Referring to FIG. 1, a flat panel display device, for example, an LCD includes an LCD panel 10, a source driver IC 12, and a gate driver IC 14.

The LCD panel 10 is configured to receive a source driving signal from the source driver IC 12 and a gate driving signal from the gate driver IC 14. The LCD panel 10 performs an operation of displaying an image by sequentially displaying the source driving signals by line in synchronization with the gate driving signal.

One or more source driver ICs 12 and one or more gate driver ICs 14 can be configured depending on the size or resolution of the LCD panel 10. In this specification, only one source driver IC 12 and one gate driver IC 14 are illustrated as being configured, for convenience of description.

Furthermore, the source driver IC 12 can be implemented in a one-chip form as shown in FIG. 1 in order to include the function of a timing controller 16. The construction of the source driver IC 12 in which the timing controller 16 is embedded is only an example for implementing the present invention, and the timing controller 16 and the source driver IC 12 may be separately configured.

In an embodiment of the present invention, the timing controller 16 is illustrated as being embedded in the source driver IC 12 as shown in FIG. 1, and a gate signal inputted to the gate driver IC 14 is generated from the timing controller 16.

The timing controller 16 generates a source signal for driving the LCD panel 10 and supplies the source signal to the source driver IC 12. The timing controller 16 generates the gate signal for scanning the source signal by line and supplies the gate signal to the gate driver IC 14.

Furthermore, the timing controller 16 provides the source driver IC 12 or the gate driver IC 14 with a control signal, including a clock pulse, a horizontal synchronization signal, or a vertical synchronization signal that is necessary to drive the source signal or the gate signal, as well as the source signal or the gate signal. In an embodiment of the present invention, in relation to the control signal, the control signal for the source driver IC 12 is defined to be included in the source signal, and the control signal for the gate driver IC 14 is defined to be included in the gate signal, for convenience of description.

The source driver IC 12 receives the source signal from the timing controller 16, generates the source driving signal corresponding to the source signal, and provides the source driving signal to the LCD panel 10.

The gate driver IC 14 receives the gate signal from the timing controller 16, generates the gate driving signal corresponding to the gate signal, and provides the gate driving signal to the LCD panel 10.

In the aforementioned construction, the timing controller 16 and the source driver IC 12 can be illustrated as being formed of a chip which is fabricated according to a low-voltage process and driven by voltage of a low-voltage domain. In contrast, the gate driver IC 14 can be illustrated as being formed of a chip which is fabricated according to a high-voltage process and driven by voltage of a high-voltage domain.

Accordingly, the timing controller 16 generates a gate signal of a low-voltage domain and provides the gate signal of a low-voltage domain to the gate driver IC 14. The gate driver IC 14 receives the gate signal of a low-voltage domain, converts the gate signal of a low-voltage domain into a gate signal of a high-voltage domain, generates a gate driving signal corresponding to the converted gate signal, and outputs the gate driving signal.

The high-voltage domain and the low-voltage domain can be illustrated as follows. For example, in the present embodiment, the high-voltage domain includes providing an operating voltage of 3.3 V to 20 V, and the low-voltage domain includes providing an operating voltage of less than 0.5 V to 3.3 V. A high-voltage domain and a low-voltage domain in accordance with the present invention are not limited to the examples. For example, a range using a relatively high operating voltage may be defined as a high-voltage domain, and a range using a relatively low operating voltage may be defined as a low-voltage domain.

Figure 2:
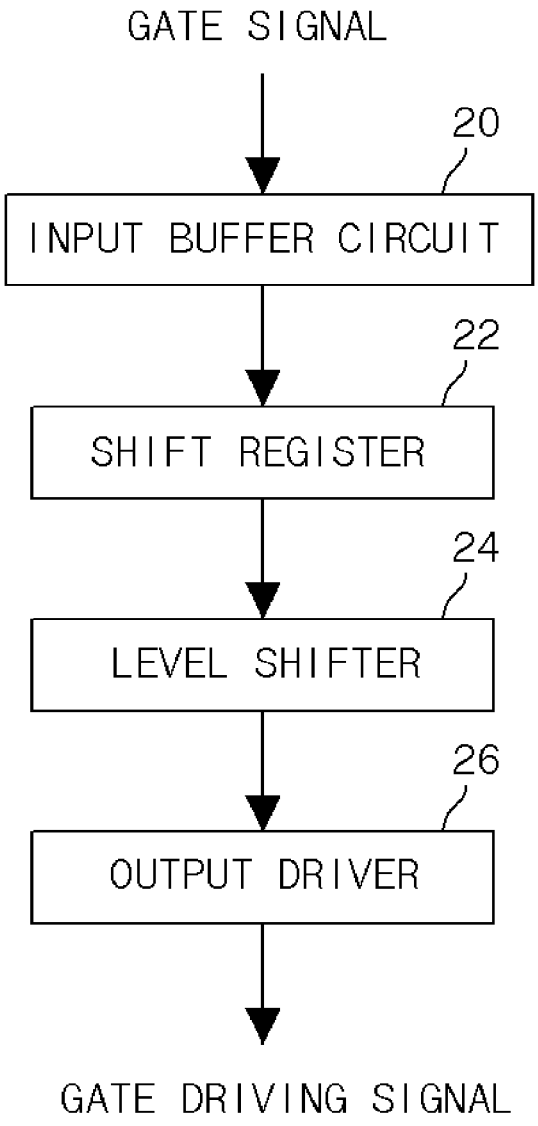
FIG. 2 is a detailed block diagram showing an exemplary embodiment of a gate driver IC of FIG. 1.

The gate signal of a low-voltage domain that is provided by the timing controller 16 is inputted to the input buffer circuit 20 of the gate driver IC 14 shown in FIG. 2. The input buffer circuit 20 receives the gate signal of a low-voltage domain and converts the gate signal of a low-voltage domain into a gate signal of a high-voltage domain. The gate driver IC 14 generates a gate driving signal in response to the gate signal of a high-voltage domain, which is output from the input buffer circuit 20, and outputs the gate driving signal.

A detailed construction and operation of the gate driver IC 14 are described below with reference to FIG. 2.

The gate driver IC 14 includes the input buffer circuit 20, a shift register 22, a level shifter 25, and an output driver 26.

Figure 3:
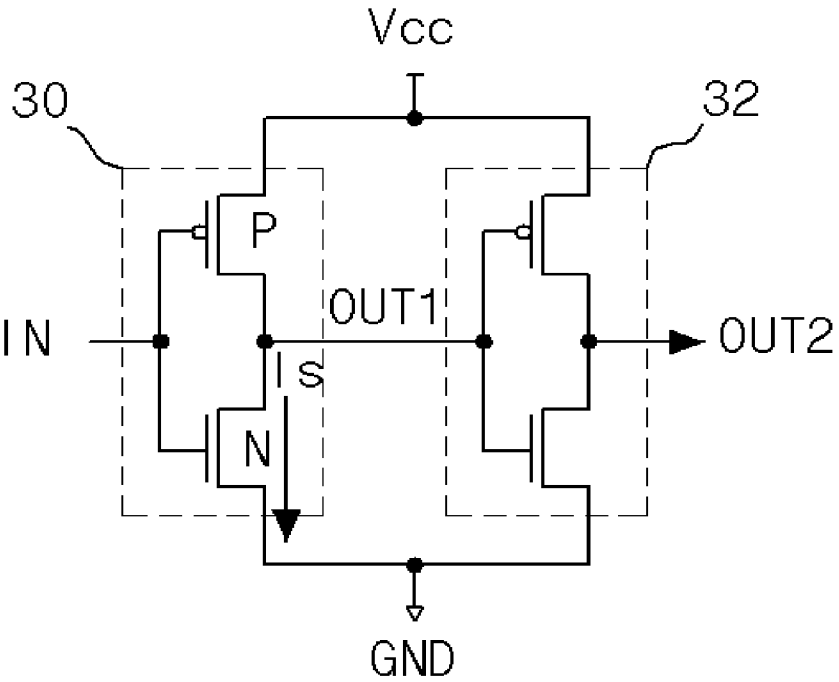
FIG. 3 is a detailed circuit diagram of an input buffer circuit of FIG. 2.

The input buffer circuit 20 receives a gate signal of a low-voltage domain, converts the gate signal of a low-voltage domain into a gate signal of a high-voltage domain, and outputs the gate signal of a high-voltage domain. For the reception and conversion of the gate signal, the input buffer circuit 20 can include multi-stage inverters 30 and 32 as shown in FIG. 3.

The shift register 22 outputs a scan pulse corresponding to the gate signal provided by the input buffer circuit 20, and the shift register 22 is controlled such that it sequentially generates the scan pulses by column of the LCD panel 10. The shift register 22 can generate the scan pulses in synchronization with the clock signal which is included in a control signal and provided by the timing controller 16.

The shift register 22 can be configured to prevent the scan pulses from overlapping with each other due to RC delay by controlling the width of each scan pulse. Such a change of the output characteristic of the scan pulse can be achieved using a circuit embedded in the shift register 22 or a circuit that can be implemented in the output terminal of the shift register 22. The circuit for changing the output characteristic of the scan pulse can be readily implemented by those skilled in the art, and a suggestion and description of a detailed circuit are omitted.

The level shifter 24 performs an operation of changing a voltage level of the scan pulse output from the shift register 22 so that the scan pulse has a level at which a TFT of the LCD panel 10 can be switched. Here, the level shifter 24 can be configured such that the output of the level shifter 24 is controlled in response to an enable signal included in the control signal.

The output driver 26 is configured to convert the scan pulse into a gate driving signal having a proper ability to drive a gate line (not shown) of the LCD panel 10, which functions as a load according to parasitic resistance and parasitic capacitance, and to output the gate driving signal.

According to the aforementioned construction, the gate driver IC 14 operates to sequentially provide the gate driving signals to all the gate lines of the LCD panel 10 at once for one frame cycle. While the gate driving signals are sequentially provided to the gate lines, the gate driver IC 14 continues to provide a gate-off voltage to gate lines to which the gate driving signal of the LCD panel 10 is not provided.

The gate driving signal may be set to voltage of about 15 V to 25 V, and the gate-off voltage may be set to voltage of about −7 V to −5 V.

The input buffer circuit 20 of FIG. 2 can include the multi-stage inverters 30 and 32 that are coupled in series as shown in FIG. 3, and the multi-stage inverters 30 and 32 of FIG. 3 are driven in a high-voltage domain.

From among the multi-stage inverters 30 and 32, the first inverter 30 is for receiving a gate signal IN of a low-voltage domain and converting the gate signal IN of a low-voltage domain into a gate signal of a high-voltage domain, and the second inverter 32 is for outputting a gate signal OUT2 of a high-voltage domain by compensating a level of the output signal OUT1 received from the first inverter 30. In an embodiment of the present invention, the input buffer circuit 20 has been illustrated as including the inverters 30 and 32 of two stages, but the present invention is not limited thereto. For example, the input buffer circuit 20 may include three-stage or more inverters that include a plurality of inverters for compensating a level according to the intention of a manufacturer.

The construction and operation of the inverters 30 and 32 of the input buffer circuit 20 of FIG. 3 are described with reference to FIGS. 4 and 5.

In FIG. 3, the inverter 30 and the inverter 32 that are coupled in series preferably have different channel ratios and different center values VIC and VIC1 of input voltages.

Figure 4:
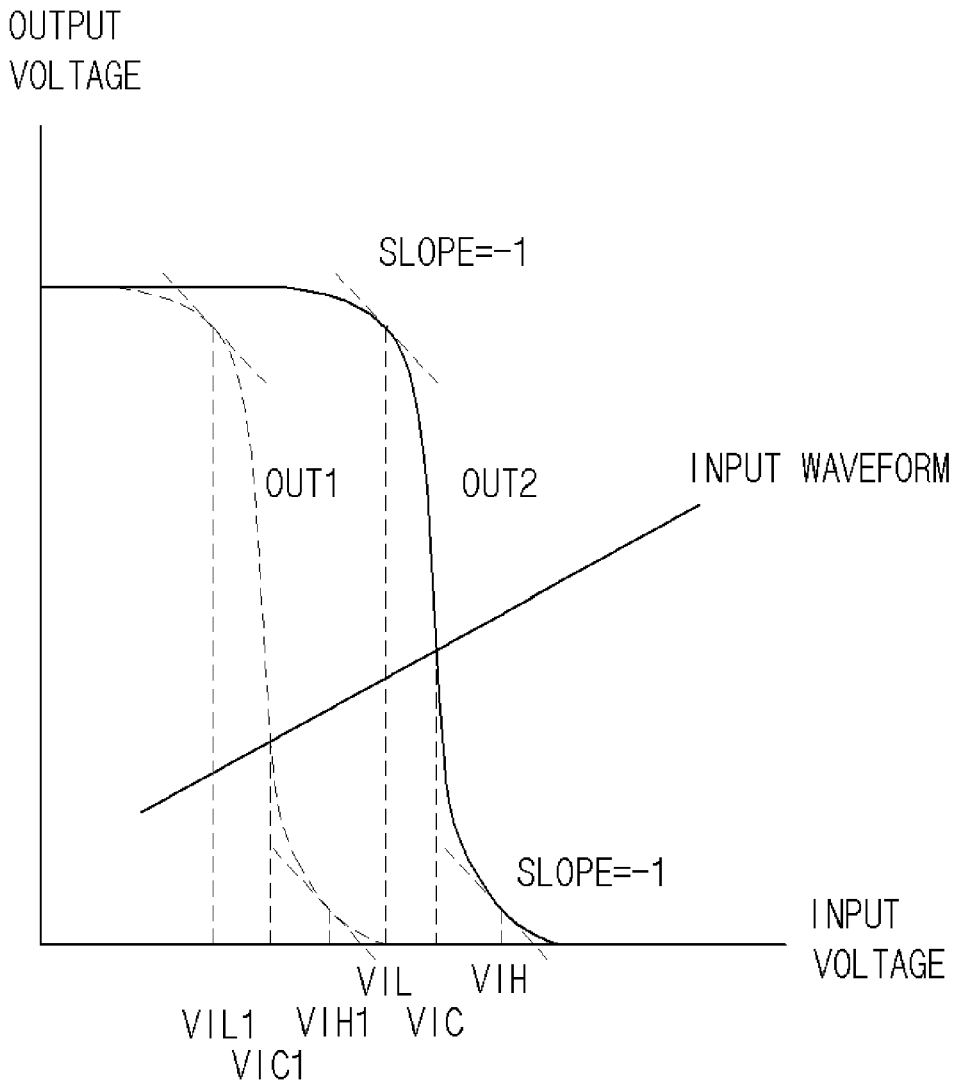
FIG. 4 is a waveform showing the input and output characteristics of an inverter.

An output characteristic of the inverter 30 that receives the gate signal IN of a low-voltage domain in FIG. 3 can be expressed by an output waveform OUT1 indicated by a dotted line of FIG. 4, and an output characteristic of the inverter 32 that outputs the gate signal OUT2 of a high-voltage domain in FIG. 3 can be expressed by an output waveform OUT2 indicated by a solid line of FIG. 4.

The inverter 32 of FIG. 3, which performs a buffer operation for receiving the output signal OUT1 of a high-voltage domain from the inverter 30 and compensating for a level of the output signal OUT1, can be illustrated as having a construction according to the design method of a common inverter. The inverter 32 has a common construction in which a channel width of the NMOS transistor N is 2 to 3 times greater than that of the PMOS transistor P due to the resistance characteristics of the NMOS transistor N and the PMOS transistor P. That is, the inverter 32 is designed to have a channel ratio of 1:2 to 1:3.

A characteristic of the output voltage of the inverter 32 to the input voltage thereof according to the characteristics can be expressed by an output waveform OUT2 indicated by a solid line of FIG. 4. Here, an input voltage at a location where an input waveform IN intersects the output waveform OUT2 can be set as the center value VIC. For example, a value of an input voltage corresponding to a location where the slope of the output waveform OUT2 is −1 can be set as the center value VIC, a value of an input voltage located on the left side of the center value VIC can be set as a low-level recognition voltage VIL, and a value of an input voltage located on the right side of the center value VIC can be set as a high-level recognition voltage VIH.

That is, assuming that an operating voltage Vcc of a high-voltage domain is 4 V and a ground voltage GND is 0 V, the center value VIC of the inverter 32 may be assumed to be 2 V, the low-level recognition voltage VIL may be assumed to be 1.7 V, and the high-level recognition voltage VIH may be assumed to be 2.3 V.

Accordingly, if the output signal OUT1 of the inverter 30, that is, a signal of a high-voltage domain, is 2.3 V or more, the inverter 32 recognizes the output signal OUT1 to be a high level and outputs a signal driven by the ground voltage GND by performing a pull-down operation. In contrast, if the output signal OUT1 of the inverter 30, that is, a signal of a high-voltage domain, is 1.7 V or less, the inverter 32 recognizes the output signal OUT1 to be a low level and outputs a signal driven by the operating voltage VCC by performing a pull-up operation.

The inverter 30 receives the gate signal IN of a low-voltage domain from the timing controller 12.

The gate signal IN has a high level or low level of a low-voltage domain. That is, assuming that the timing controller 16 operates in a low-voltage domain having an operating voltage of 2 V, a high level of a full-swing state of the gate signal IN may be set to 2 V, and a low level of the full-swing state of the gate signal IN may be assumed to be 0 V.

The inverter 30 is configured to have a center value at which the gate signal IN of a low-voltage domain can be recognized in relation to a channel ratio of the NMOS transistor N and the PMOS transistor P. That is, the inverter 30 is configured to have a center value lower than that of the inverter 32. Here, the center value of the inverter 30 can be set to be the same or lower than a center value of the voltage domain of the timing controller 16 that sends the gate signal IN.

For example, the center value of the inverter 30 may be set within a range of 0.5 V to 2.5 V and preferably may be set within a range of 0.7 V to 1.1 V by taking the low-voltage domain having the operating voltage of 2 V into consideration.

In order for the inverter 30 to have the center value ranging from 0.7 V to 1.1 V, the channel ratio between the PMOS transistor P and the NMOS transistor N of the inverter 30 is set to be higher than that of the inverter 32. A channel ratio of the PMOS transistor P to the NMOS transistor N of the inverter can be determined according to the intention of a manufacturer, for example, within 1:4 to 1:25 in order to achieve a desired center value.

That is, if the channel ratio between the PMOS transistor P and the NMOS transistor N of the inverter 30 is greater than that of the inverter 32, the output signal OUT1 according to the characteristics of the inverter 30 can be expressed by the output waveform OUT1 indicated by a dotted line of FIG. 4. Here, an input voltage at a location where an input waveform IN intersects the output waveform OUT1 can be set as the center value VIC1. Furthermore, a value of an input voltage corresponding to a location where a slope of the output waveform OUT1 is −1 can be set as the center value VIC1, a value of an input voltage located on the left side of the center value VIC1 can be set as a low-level recognition voltage VIL1, and a value of an input voltage located on the right side of the center value VIC1 can be set as a high-level recognition voltage VIH1.

For example, if the center value VIC1 is set to 1.63 V, the low-level recognition voltage VIL1 can be set to 1.39 V, and the high-level recognition voltage VIH1 can be set to 1.88 V. If the center value VIC1 is set to 1.0 V, the low-level recognition voltage VIL1 can be set to 0.75 V, and the high-level recognition voltage VIH1 can be set to 1.08 V. If the center value VIC1 is set to 0.9 V, the low-level recognition voltage VIL1 can be set to 0.69 V, and the high-level recognition voltage VIH1 can be set to 0.96 V.

Accordingly, assuming that the inverter 30 is set to have the center value VIC1 of 1.0 V, if the gate signal is 1.08 V or more, the inverter 30 recognizes the gate signal to be a high level and outputs a signal driven by the ground voltage GND of a high-voltage domain by performing a pull-down operation. In contrast, if the gate signal is 0.75 V or less, the inverter 30 recognizes the gate signal to be a low level and outputs a signal driven by the operating voltage VCC of a high-voltage domain by performing a pull-up operation.

When the inverter 30 and the inverter 32 operate as described above, the input buffer circuit 20 can recognize the gate signal IN, convert the gate signal IN of a low-voltage domain into the gate signal IN of a high-voltage domain, and output the gate signal IN of a high-voltage domain.

Figure 5:
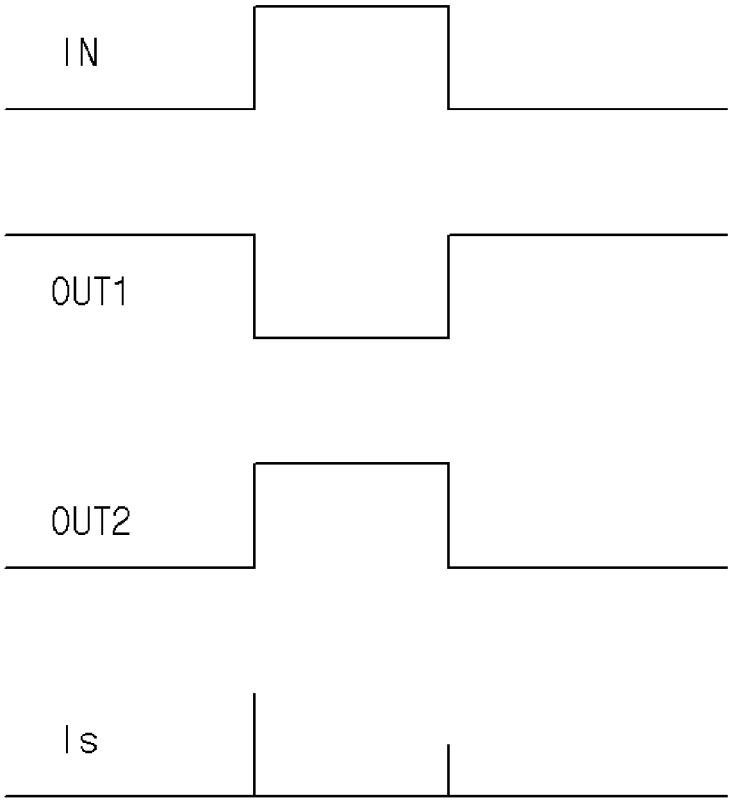
FIG. 5 is a timing diagram showing the input and output waveforms of an inverter and a leaking static current.

Referring to FIG. 5, when the gate signal IN of a low-voltage domain is inputted to the inverter 30, the inverter 30 outputs the output signal OUT1 inverted from the gate signal IN. The gate signal IN applied to the inverter 30 is a low-voltage signal, whereas the output signal OUT1 output from the inverter 30 is a high-voltage signal.

When the output signal OUT1 of the inverter 30 is applied to the inverter 32, the inverter 32 outputs the gate signal OUT2 inverted from the output signal OUT1 of the inverter 30. Both the output signal OUT1 applied to the inverter 32 and the gate signal OUT2 are high-voltage signals.

Here, since the inverter 32 includes a combination of the NMOS transistor N and the PMOS transistor P, when the gate signal IN is placed between the high-level recognition voltage VIH1 and the low-level recognition voltage VIL1, that is, at a floating point of time at which the gate signal IN shifts to a high level or a low level, a leakage current Is can be generated as shown in FIG. 5.

However, the leakage current Is, that is, a static current, does not affect the operation of the gate driver IC 14 because the leakage current Is is a negligible level.

As described above, the inverter 30 of the input buffer circuit 20 can recognize the gate signal IN of a low-voltage domain and output the inverted output signal OUT1 of a high-voltage domain. Therefore, the gate driver IC 14 in which the input buffer circuit 20 is embedded can perform an operation of receiving the gate signal of a low-voltage domain and outputting the gate driving signal.

That is, the gate driver IC 14 in accordance with the present invention can recognize the gate signal of a low-voltage domain by changing a channel ratio of some inverters of the input buffer circuit 20 typically configured to receive a signal without configuring an additional circuit in order to recognize the gate signal of a low-voltage domain.

Therefore, in accordance with an embodiment of the present invention, an interface through which chips having different voltage domains, such as the gate driver IC 14 and the timing controller 16, can transmit and receive signals can be simply implemented. Accordingly, the present invention has an advantage in that a burden of an increased chip size can be solved.

In the aforementioned embodiment of the present invention, a chip operating in a low-voltage domain is illustrated as being the timing controller 16, and a chip operating in a high-voltage domain is illustrated as being the gate driver IC 14, but the technical spirit of the present invention is not limited thereto. The chip operating in a low-voltage domain and the chip operating in a high-voltage domain may also be applied to other chips implemented according to the technical spirit of the present invention. In other words, the present invention can be implemented into a variety of other embodiments in which when a chip operating in a low-voltage domain sends a signal of a low-voltage domain to a chip operating in a high-voltage domain, the chip operating in a high-voltage domain recognizes a signal of a low-voltage domain.

Meanwhile, the present invention discloses technology in which an interface having extended compatibility for signals can be provided because the present invention is implemented to select signals of different voltage domains and to convert the selected signals. An embodiment having compatibility through which the signals of different voltage domains can be processed is described below with reference to FIGS. 6 to 9.

Figure 6:
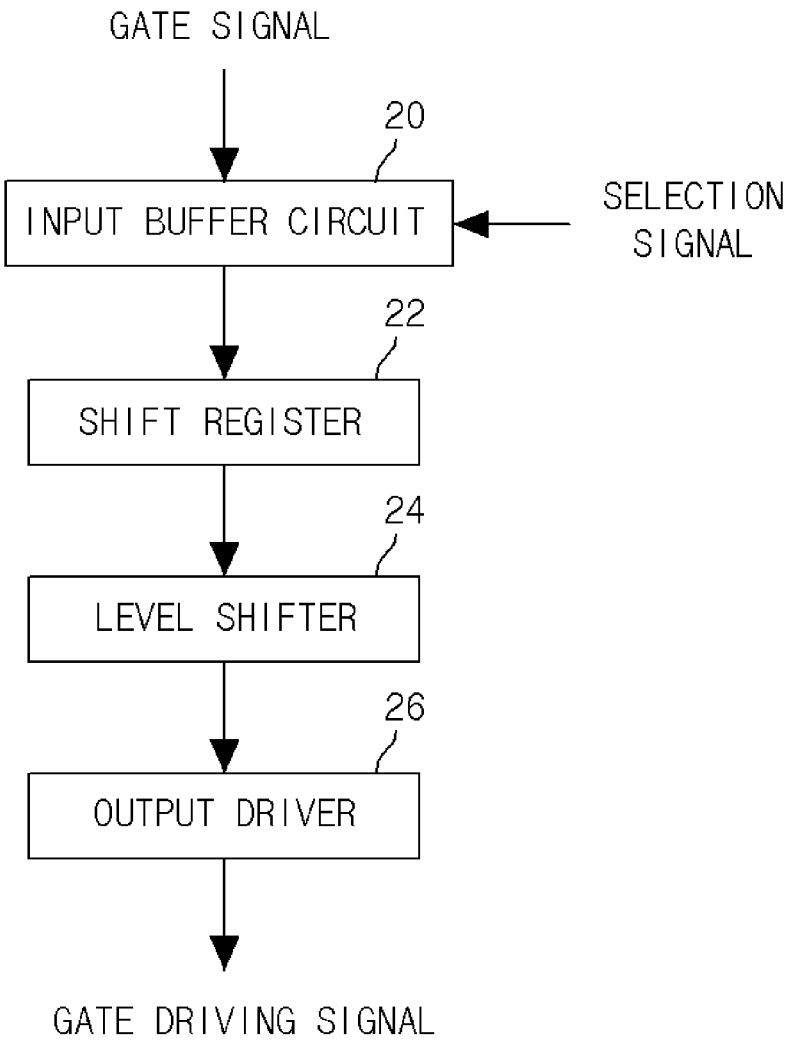
FIG. 6 is a detailed block diagram showing another exemplary embodiment of the gate driver IC of FIG. 1.

The gate driver IC 14 of FIG. 6 is the same as that of the embodiment of FIG. 2 in that it includes the input buffer circuit 20, the shift register 22, the level shifter 24, and the output driver 26, but the input buffer circuit 20 of FIG. 6 has a different construction from that of the embodiment of FIG. 2 in that it is configured to receive selection signals.

The shift register 22, the level shifter 24, and the output driver 26 of the gate driver IC 14 of FIG. 6 have the same construction and operation of those of FIG. 2, and thus a redundant description thereof is omitted.

Figure 7:
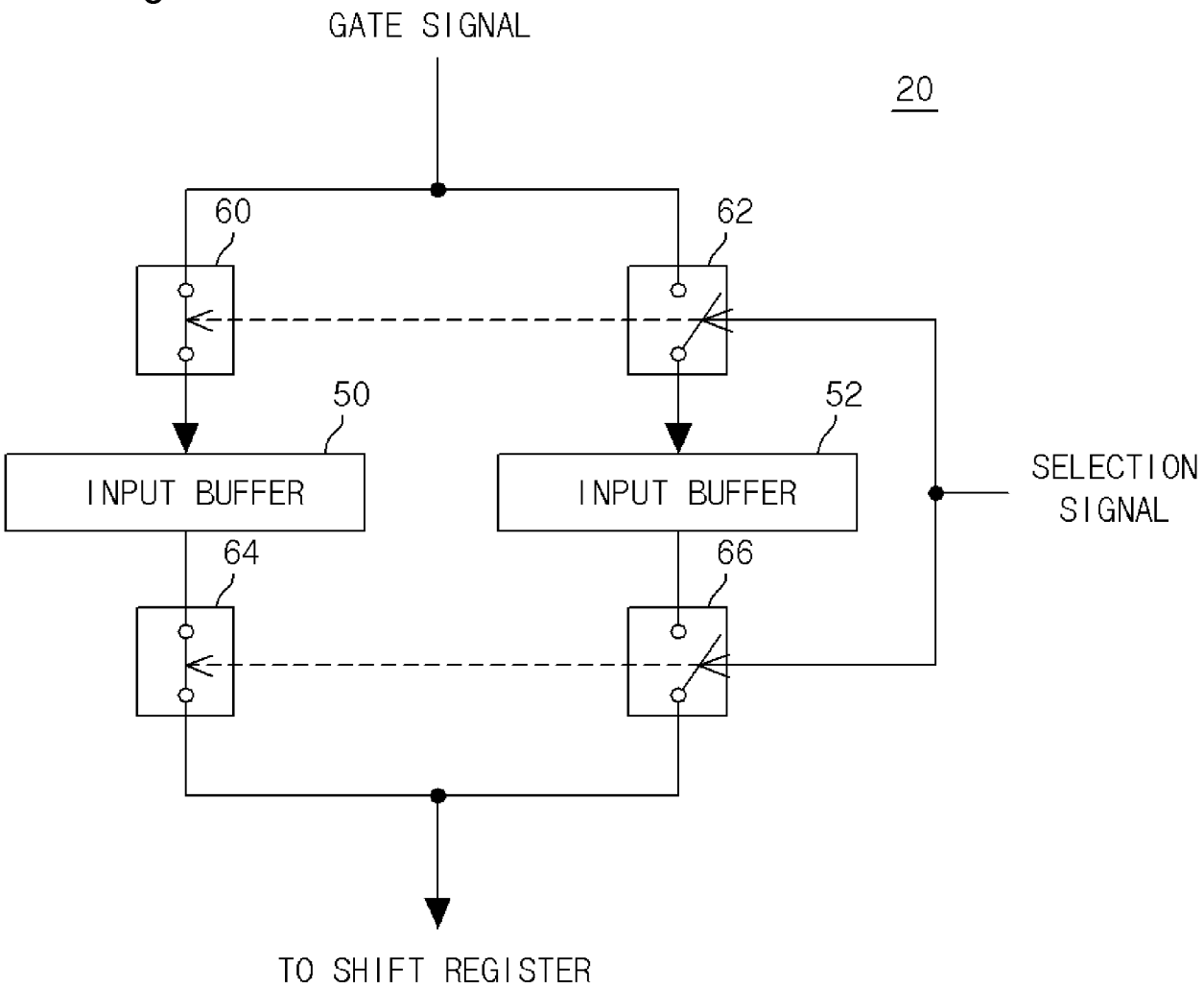
FIG. 7 is a detailed block diagram of an input buffer circuit of FIG. 6.

Furthermore, the input buffer circuit 20 of FIG. 6, as shown in FIG. 7, can be implemented to include input buffers 50 and 52 capable of recognizing gate signals of different voltage domains.

The input buffer circuit 20 of FIG. 7 has been illustrated as including, for example, two input buffers 50 and 52, but may be configured to include three or more input buffers depending on an option, that is, the number of gate signals. The input buffers 50 and 52 of the input buffer circuit 20 are configured to receive signals of different voltage domains. Furthermore, the number of input buffers can be varied according to the intention of a manufacturer, and thus detailed examples and a description thereof are omitted.

Referring to FIG. 7, the input buffer circuit 20 can include two input buffers 50 and 52 and four switch circuits 60 to 66. Two switch circuits 60 and 62 of the four switch circuits 60 to 66 are configured as selection circuits for performing switching operations of transferring gate signals to the input buffers 50 and 52, and the two switch circuits 64 and 66 are configured as output circuits for performing switching operations of transferring signals output from the input buffers 50 and 52 to the shift register 22. The switch circuits 60 and 64 are coupled with the input side and the output side of the input buffer 50, thus forming one gate signal processing path. The switch circuits 62 and 66 are coupled with the input side and the output side of the input buffer 52, thus forming the other gate signal processing path. Furthermore, the switch circuit 60 and the switch circuit 62 complementarily perform switching operations, and the switch circuit 64 and the switch circuit 66 also complementarily perform switching operations. For the switching operations, selection signals are inputted to the switch circuits 60, 62, 64, and 66. The switch circuits 60 and 64 and the switch circuits 62 and 66 can be configured to complementarily switch in response to the same selection signal.

The selection signal is a control signal for controlling whether a gate signal inputted to the input buffer circuit 20 will be processed via the input buffer 50 or the input buffer 52 depending on a voltage domain of the gate signal. Furthermore, the selection signal can be provided by an internal option switch or an external timing controller, such as a fuse within the gate driver IC 14.

In an embodiment of the present invention, it is assumed that the input buffer 50 is designed to recognize a gate signal operating in a voltage domain that is higher than that of a gate signal recognized by the input buffer 52, the switch circuits 60 and 64 are designed to be turned on when a selection signal shifts to a high state, and the switch circuits 62 and 66 are designed to be turned on when a selection signal shifts to a low state.

For example, in order to describe an embodiment of the present invention, the gate driver IC 14 can be supplied with a gate signal of a low-voltage domain or a gate signal of a high-voltage domain, the gate signal of a low-voltage domain can be illustrated as corresponding to a voltage domain of the timing controller 16, and the gate signal of a high-voltage domain can be illustrated as corresponding to a voltage domain of the gate driver IC.

In this case, the gate driver IC 14 can have compatibility in which it can receive and process both the gate signal of a low-voltage domain output from the timing controller 16 and the gate signal of a high-voltage domain converted by and output from the timing controller 16.

If a gate signal of a high-voltage domain is provided to the gate driver IC 14, a selection signal shifted to a high state is provided to the gate driver IC 14, and the switch circuits 60 and 64 are turned on in response to the selection signal. That is, the gate signal of a high-voltage domain is provided to the input buffer 50. In contrast, if a gate signal of a low-voltage domain is provided to the gate driver IC 14, a selection signal shifted to a low state is provided to the gate driver IC 14, and the switch circuits 62 and 66 are turned on in response to the selection signal. That is, the gate signal of a low-voltage domain is provided to the input buffer 52.

Figure 8:
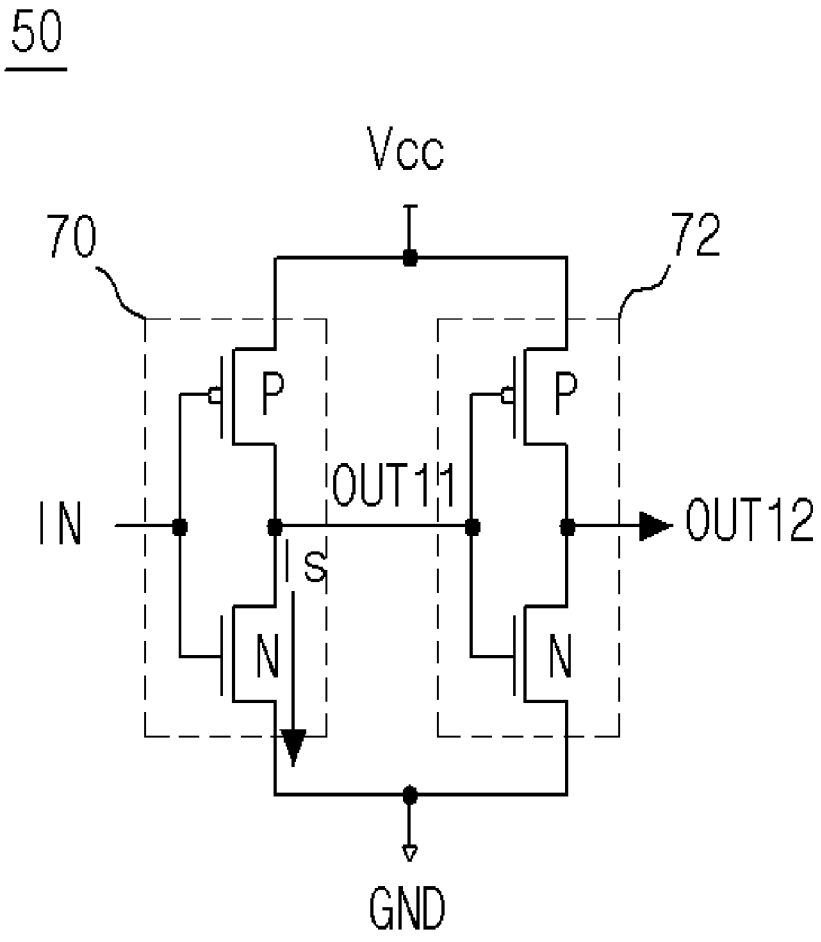
FIG. 8 is a detailed circuit diagram of an input buffer 50 of FIG. 7.
Figure 9:
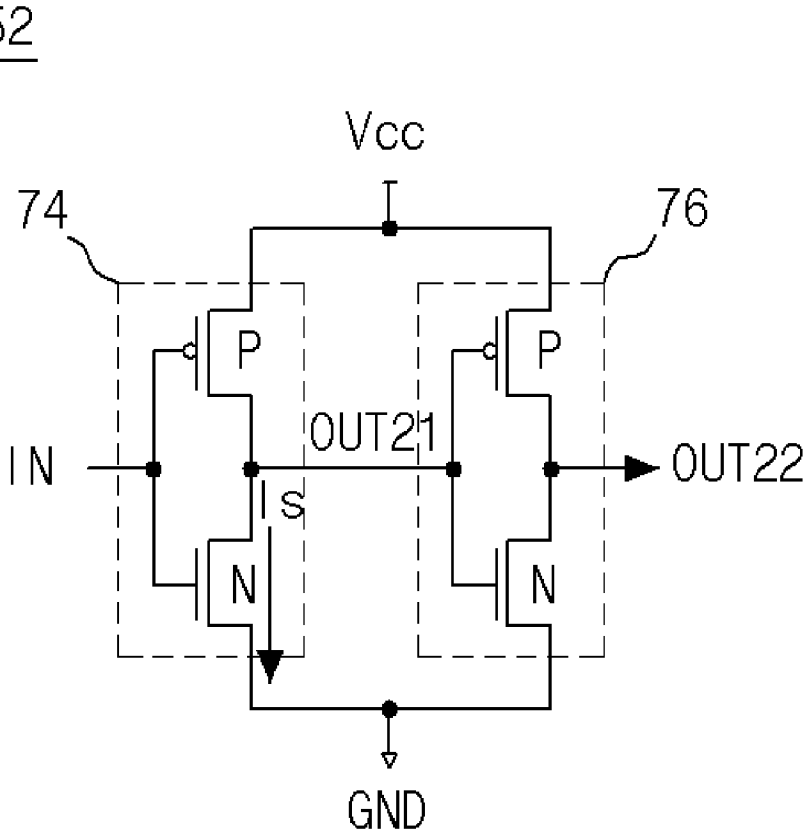
FIG. 9 is a detailed circuit diagram of an input buffer 52 of FIG. 7.

The input buffers 50 and 52 are configured to include multi-stage inverters 70, 72 and 74, 76 as shown in FIGS. 8 and 9. The multi-stage inverters 70, 72 and 74, 76 are driven by the operating voltage Vcc of a high-voltage domain.

The inverter 70 of the input buffer 50 is configured to receive a gate signal IN of a high-voltage domain and to output an output signal OUT11 of a high-voltage domain. Furthermore, the inverter 72 of the input buffer 50 is configured to compensate for a level of the output signal OUT11 of a high-voltage domain from the inverter 70 and to output a gate signal OUT12 of a high-voltage domain.

Furthermore, the inverter 74 of the input buffer 52 is configured to receive a gate signal IN of a low-voltage signal and to output an output signal OUT21 of a high-voltage domain. Furthermore, the inverter 76 of the input buffer 52 is configured to compensate for a level of the output signal OUT21 of a high-voltage domain from the inverter 74 and to output a gate signal OUT22 of a high-voltage domain.

In an embodiment of the present invention, the input buffers 50 and 52 have been illustrated as including two-stage inverters 70, 72 and 74, 76, but the present invention is not limited thereto. For example, each of the input buffers 50 and 52 may be configured to include three-stage or more inverters according to the intention of a manufacturer.

The constructions and operations of the inverters 70, 72 and 74, 76 of the input buffers 50 and 52 of FIGS. 8 and 9 are described with reference to FIGS. 4 and 5.

The inverters 70 and 72 of the input buffer 50 of FIG. 8 can be configured to have center values at which signals of a high-voltage domain are received. That is, the inverter 70 of FIG. 8 is configured to receive the gate signal IN of a high-voltage domain and to provide the output signal OUT11 of a high-voltage domain by performing a pull-up or pull-down operation depending on a level of the gate signal IN. Furthermore, the inverter 72 of FIG. 8 is configured to receive the output signal OUT11 of a high-voltage domain and to provide the gate signal OUT12 of a high-voltage domain by performing a pull-up or pull-down operation depending on a level of the output signal OUT11.

Each of the inverters 70 and 72 can be illustrated as having a construction according to the design method of a common inverter for performing a buffer operation of compensating for a level of an input signal. The inverters 70 and 72 can be designed to have a channel ratio of 1:2 to 1:3. Furthermore, the inverters 70 and 72 can be configured to have the center value VIC corresponding to an input voltage of a high-voltage domain according to the channel ratio. A value located on the left side of the center value VIC of the input voltage can be set as the low-level recognition voltage VIL, and a located on the right side of the center value VIC of the input voltage can be set as the high-level recognition voltage VIH.

The input buffer 50 of FIG. 8 configured as described above converts the gate signal IN of a high-voltage domain IN into the output signal OUT11 of a high-voltage domain, compensates for a level of the output signal OUT11 of a high-voltage domain, and outputs a signal having the compensated level as the gate signal OUT12 of a high-voltage domain.

In contrast, the inverters 74 and 76 of the input buffer 52 of FIG. 9 are configured to correspond to those of the input buffer circuit 20 of FIGS. 2 and 3 and to have different center values VIC and VIC1 because they have different channel ratios.

A characteristic of the output signal OUT21 of the inverter 74 of the input buffer 52 in FIG. 9 can be expressed by the output waveform OUT1 indicated by a dotted line of FIG. 4, and a characteristic of the gate signal OUT21 of the inverter 76 of the input buffer 52 in FIG. 9 can be expressed by the output waveform OUT2 indicated by a solid line of FIG. 4.

The inverters 74 and 76 of the input buffer 52 of FIG. 9 are configured to have the same construction as those of the input buffer circuit 20 of FIGS. 2 and 3 and to have different center values VIC and VIC1 because they have different channel ratios.

That is, the inverter 74 of FIG. 9 is configured to have a center value at which a low-voltage domain can be recognized in relation to a channel ratio of the NMOS transistor N and the PMOS transistor P so that the gate signal IN of a low-voltage domain can be recognized. That is, the inverter 74 is configured to have the center value VIC1 of an input voltage lower than that of the inverter 76, a value located on the left side of the center value VIC1 of the input voltage can be set as the low-level recognition voltage VIL1, and a value located on the right side of the center value VIC1 of the input voltage can be set as the high-level recognition voltage VIH.

Furthermore, the inverter 76 of FIG. 9 can be illustrated as having a construction according to the design method of a common inverter for performing a buffer operation of receiving the output signal OUT21 of a high-voltage domain and of compensating for a level of the output signal OUT21. The inverter 76 of FIG. 9 can have the same construction as the inverter 70, 72 of FIG. 8, and thus a detailed description thereof is omitted.

The gate driver IC 14 configured as shown in FIG. 6 in accordance with the present invention can receive a gate signal of a different voltage domain depending on an option, generate a gate driving signal according to an internal processor, and output a gate driving signal.

That is, if the gate signal has a low-voltage domain, the gate signal can be recognized by the inverter 74 of the input buffer 52 of FIG. 9. If the gate signal has a high-voltage domain, the gate signal can be recognized by the inverter 70 of the input buffer 50 of FIG. 8.

As described above, the first inverter 70, 74 of the input buffer 50, 52 of the input buffer circuit 20 can recognize the gate signal IN of a low-voltage domain or a high-voltage domain, operate in a high-voltage domain in response to the gate signal IN, and output the inverted output signal OUT1. The gate driver IC 14 in which the input buffer circuit 20 is embedded can have an interface compatibility in which the gate driver IC 14 can operate in response to a gate signal of a low-voltage domain or a gate signal of a high-voltage domain.

An embodiment of the present invention can provide an option in which the gate driver IC 14 can operate in response to gate signals of various low-voltage domains. That is, an embodiment of the present invention can actively handle a changed design by selecting an option without changing a circuit or additionally configuring a part even in the case of the design to which a gate signal having a changed voltage domain has been applied.

As is apparent from the above description, the present invention provides a signal interface environment between chips that operate in different voltage domains and, in particular, a reception chip of a high-voltage domain can receive, convert, and internally process a low-voltage signal. Therefore, there is an advantageous effect in that the chip size of chips that exchange signals can be reduced.

Furthermore, the present invention can provide an interface environment in which two or more signals having different voltage domains can be selected and converted and has an advantage in that the input buffer and the gate driver IC can be configured to have compatibility for signals having different voltage domains.

Although a preferred embodiment of the present invention has been described for illustrative purposes, those skilled in the art will appreciate that various modifications, additions and substitutions are possible, without departing from the scope and the spirit of the invention as disclosed in the accompanying claims.

What is claimed is:

1. An input buffer circuit, comprising:

a first input buffer configured to comprise two or more inverters coupled in multiple stages;

a second input buffer configured to comprise two or more inverters;

a transfer circuit configured to transfer an input signal to any one of the first input buffer and the second input buffer in response to an external selection signal; and an output circuit configured to select the first input buffer or the second input buffer to which the input signal has been transferred in response to the selection signal and output a signal received from the first input buffer or the second input buffer, wherein center values of input voltages to first inverters of the first input buffer and the second input buffer are differently set in order to recognize the input signals of different voltage domains, wherein the center value of the input voltage to the first inverter of the second input buffer to which the input signal is applied is set to be lower than center values of input voltages of remaining inverters following the first inverter, and wherein the first inverter of the second input buffer is configured to receive a low-voltage signal and output a high-voltage domain.

2. The input buffer circuit of claim 1, wherein the inverters of the first input buffer and the second input buffer are driven by an operating voltage having an identical voltage domain.

3. The input buffer circuit of claim 1, wherein center values of input voltages to the inverters of the first input buffer are set identically.

4. The input buffer circuit of claim 1, wherein a channel ratio between an NMOS transistor and a PMOS transistor of the first inverter of the second input buffer to which the input signal is applied is set to be higher than a channel ratio between an NMOS transistor and a PMOS transistor of each of remaining inverters following the first inverter.

5. The input buffer circuit of claim 1, wherein the center value of the input voltage to the first inverter of the second input buffer to which the input signal is applied is set to be lower than the center value of the input voltage to the first inverter of the first input buffer.

6. The input buffer circuit of claim 1, wherein:

the input signal is a gate signal of a flat panel display device, and the center value of the input voltage to the first inverter of the second input buffer is identical with or lower than a center value of a voltage domain of an operating voltage for driving a chip that sends the gate signal.

* * * * *